US006488549B1

(12) United States Patent
Weller et al.

(10) Patent No.: US 6,488,549 B1
(45) Date of Patent: Dec. 3, 2002

(54) ELECTRICAL CONNECTOR ASSEMBLY WITH SEPARATE ARCING ZONES

(75) Inventors: Steven Andrew Weller, Camp Hill, PA (US); Lori Ann Mayer, Harrisburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 09/875,689

(22) Filed: Jun. 6, 2001

(51) Int. Cl.[7] ..... H01R 13/11
(52) U.S. Cl. ..... 439/856; 439/181
(58) Field of Search ..... 439/181, 682, 439/856, 857

(56) References Cited

U.S. PATENT DOCUMENTS 5,104,329 A 4/1992 Brown et al.
5,116,230 A 5/1992 Dechelette et al.
5,169,324 A 12/1992 Lemke et al.
5,582,519 A 12/1996 Buchter
5,749,755 A * 5/1998 Genta et al. ..... 439/856

* cited by examiner

*Primary Examiner*—Tho D. Ta
*Assistant Examiner*—Felix O. Figueroa

(57) ABSTRACT

An electrical contact assembly is provided that includes insolated blade and receptacle connector housings mateable with one another while moved from initial to final mating positions. A blade contact is provided with a support section that is securely mounted within the insulated connector housing. The blade contact further includes a contact knife projecting from the support section. A receptacle contact is provided having a base section that is securely mounted in the insulated receptacle housing. Arcing zones are defined on the blade and receptacle contacts that are located separate and apart from mating zones. The arcing zones electrically engage one another only when the blade and receptacle contacts are located in the initial mating position to provide a temporary electrical interface for discharging arcs between the blade and receptacle contacts. After which, the arcing zones disengage one another.

24 Claims, 8 Drawing Sheets

ELECTRICAL CONNECTOR ASSEMBLY WITH SEPARATE ARCING ZONES

BACKGROUND OF THE INVENTION

At least one embodiment of the present invention generally relates to an electrical connector assembly having mateable contact pairs and more specifically, a connector assembly including predefined arcing zones located separate and apart from the final mating zones between blade and receptacle contacts.

In the past, ground and signal contact assemblies have been proposed that comprise pairs of mating receptacle and blade contacts. U.S. Pat. No. 5,116,230 generally describes a make-first-break-last connector assembly provided by making ground pins of a pin header longer than signal pins of the header in order that the ground pins engage ground contacts of a mating connector before the signal pins engage signal contacts thereof. U.S. Pat. No. 5,104,329 describes a connector assembly that uses ground plates, not ground pins, to afford a make-first-break-last connector assembly. U.S. Pat. No. 5,169,324 discloses an electrical connector assembly in which a connector mounted on a circuit board has signal contact springs for mating with complimentary contact elements of a mating connector similarly mounted on the circuit board. A planar grounding blade projects beyond the signal contact spring for mating with a grounding contact of the mating connector.

U.S. Pat. No. 5,582,519 discloses an alternative make-first-break-last connection. A pair of mating electrical ground contacts comprise a blade contact having a rearward blade support for retention in a first insulating housing and a contact blade projecting forwardly from the blade support, with a tab substantially narrower than the contact blade projecting forward from a forward edge of the contact blade. The pair of ground contacts comprises a receptacle contact having a rearward base for retention in an insolated housing and first and second contact springs projecting forwardly from the base. The first contact spring has a first transverse contact surface, while the second contact spring has a transverse contact surface that is substantially wider than the tab. The contact surfaces of the contact springs cooperate to apply contact forces to the tab and to the contact blade as the ground contacts are mated. The second contact spring defines a rearward opening for receiving the tab to allow full mating of the contact blade with the receptacle contact.

Connectors are being used in applications with higher and higher electrical performance demands, and thus improvement is needed to satisfy such demands. By way of example, today high performance connectors are in demand for applications such as telecommunications, computer systems requiring motherboard and daughter board connections, servers, networks, internet applications and the like. These applications use connectors having separable interfaces that may be connected and disconnected repeatedly while still affording high signal performance characteristics.

More recently, the power and signal requirements have been extended to new levels, such as for example, but not limited to, power connectors capable of carrying 50 volt DC power supplies at 30 amps per contact. In addition, signal contacts are needed to carry signals rated in different rating tiers, such as at or near 2.5 GHz (Tier 1), 5 GHz (Tier 2), 10 GHz (Tier 3), and the like. An improved electrical connector assembly is needed to satisfy the higher power and signal requirements of today's applications.

In addition, connector assemblies are needed that better address the electrical phenomenon associated with "hot-plugging" or static electricity discharge. Hot-plugging refers to the process whereby the connector halves are mated while power continues to be applied to the board already mounted in the system. When cards or boards are added to the system while the power is on, arcing may occur. Another example is when circuit cards are stored before use, such cards collect static electricity. The collection of static electricity is not limited to motherboard and daughter card types of circuits. Instead, many other types of components and subassemblies have a tendency to collect static electricity during storage. The static electricity builds up in the component, card or subassembly until discharge to a ground. Typically these components are not grounded during storage, but instead are grounded for the first when inserted into a server, network, computer or other application. At the time that the card, component, subassembly and the like is inserted into a system, an electricity discharge may occur whether it be due to static electricity, hot-plugging or otherwise. In conventional connectors, the discharge occurs between the contacts at the mating interface where power or data signals are to be transferred to the card, component or subassembly once plugged into a server, network, computer and the like.

With today's high electrical signal and power performance requirements of mateable connectors, the sensitivity of such connectors to electrical discharge is heightened. By way of example only, certain connectors may be coated at the mating interface with a material to facilitate the connection, such as gold plating and the like. However, the coating material becomes damaged and removed when arcing occurs since the coating material is not well suited to withstand the high voltage and/or current spikes that occur with hot-plugging or static electricity arc-type discharges. As the coating material degrades, the mating interface becomes susceptible to corrosion. As corrosion progresses, the resistance increases at the mating interface between the two connector halves of the contact assembly which in turn causes heating within the contacts. The chain of events (e.g., electrical discharge, corrosion, increased resistance and heating) induces an upper limit on the performance characteristics of the contact, such as by limiting the amount of power that the contact may handle and/or limiting the signal to noise characteristics maintainable by the contact for high data transmission speeds. In addition, as connectors are repeatedly unplugged and remated, the potential for additional build-up of a static electricity and discharge exists with each mating operation, thereby further exaggerating the foregoing problems.

A need remains for an improved connector that is capable of withstanding arcing in a manner that does not degrade the mating interface of the connector assembly.

BRIEF SUMMARY OF THE INVENTION

An embodiment of the present invention is provided in which a pair of mating electrical contacts include a blade contact and a receptacle contact. The blade contact includes a support section that is securely mounted in an insulated connector housing and has at least one contact knife projecting from the support section. The receptacle contact has a base section that is securely mounted in an insulated receptacle housing and has at least one contact spring projecting from the base section. The blade and receptacle contacts are joined in a mating operation as the blade and receptacle contacts move from initial to final mating positions.

Blade and receptacle mating zones are defined on the blade and receptacle contacts, respectively. The mating zones electrically engage one another when the blade and receptacle contacts are moved to the final mating position to establish and maintain a primary electrical interface between the blade and receptacle contacts. Arcing zones are defined separate and distinct from the mating zones, with the arcing zones on the blade and receptacle contacts only being electrically engaged with one another when the blade and receptacle contacts are located in the initial mating position. The arcing zones provide a temporary electrical interface for discharging static electrical charge between the blade and receptacle contacts.

In accordance with one embodiment, raised dimples may be used on the blade and receptacle contacts to define signal and power interface regions and arcing regions located separate and remote from one another. The signal/power interface regions maintain the primary electrical interface, while the arcing regions provide temporary electrical interfaces. Alternatively, raised bumps may be used to define the blade and receptacle arcing zones. The bumps may be located on a sacrificial portion of an associated one of the blade and receptacle contacts remote from the primary electrical interface.

Alternatively, or in addition, multiple raised bumps may be used to define at least one of the blade and receptacle mating zones. The bumps may be located on a portion of an associated of the blade and receptacle contacts remote from areas that potentially experience arcing during a mating operation.

In accordance with at least one embodiment, the receptacle contacts are constructed with first and second contact springs projecting forward from a base section and cantilevered beams. The beams and springs define a gap there between to receive the knife contact. A crossbar is provided connecting outer ends of the first and second contact springs, with the crossbar including receptacle arcing zones thereon. Optionally, at least one of the first and second contact springs may also include a receptacle mating zone thereon.

Alternatively, a contact spring assembly may be provided that includes a proximal region near the base section constituting the receptacle mating zone and a distal region remote from the base section constituting the receptacle arcing zone. The distal region may come into contact with the blade contact during the mating operation when in the initial mating position, while the proximal region comes into contact with the blade contact during the mating operation only when in the final mating position.

As yet a further alternative, the receptacle contacts may be constructed in a U-shape with opposed spring legs projecting from a base section and joined with an interconnect at outer ends of the spring legs. The interconnect may include arcing zones, while the spring legs may include mating zones.

In accordance with one embodiment, an electrical contact assembly is provided that includes an insulated blade connector housing having a mating cavity in one end thereof and an insulated receptacle connector having a mating section adapted to be inserted into the mating cavity during a mating operation. A blade contact is securely mounted in the insulated connector housing and includes at least one contact arm extending into the mating cavity. A receptacle contact is securely mounted in an insulated receptacle housing and has at least one contact spring housed within the mating section. The blade and receptacle housings are joined in a mating operation in which the blade and receptacle contacts move from initial to final mating positions.

Mating interfaces on the blade and receptacle contacts are positioned to electrically engage one another when the blade and receptacle housings are moved to the final mating position. The mating interface is maintained at the primary electrical interface between the blade and receptacle contacts so long as in the final mating position. Arcing points are also provided on the blade and receptacle contacts and are located remote from the mating interfaces. The arcing points temporarily electrically communicate with one another only while the blade and receptacle connector housings are in the initial mating position to provide a temporary electrical interface affording an arcing point between the blade and receptacle contacts.

BRIEF DESCRIPTION OF THE DRAWINGS

The foregoing summary, as well as the following detailed description of the preferred embodiments of the present invention, will be better understood when read in conjunction with the appended drawings. For the purpose of illustrating the invention, there is shown in the drawings, embodiments which are present preferred.

It should be understood, however, that the present invention is not limited to the precise arrangements and instrumentality shown in the attached drawings.

DETAILED DESCRIPTION OF THE INVENTION

Figure 1:
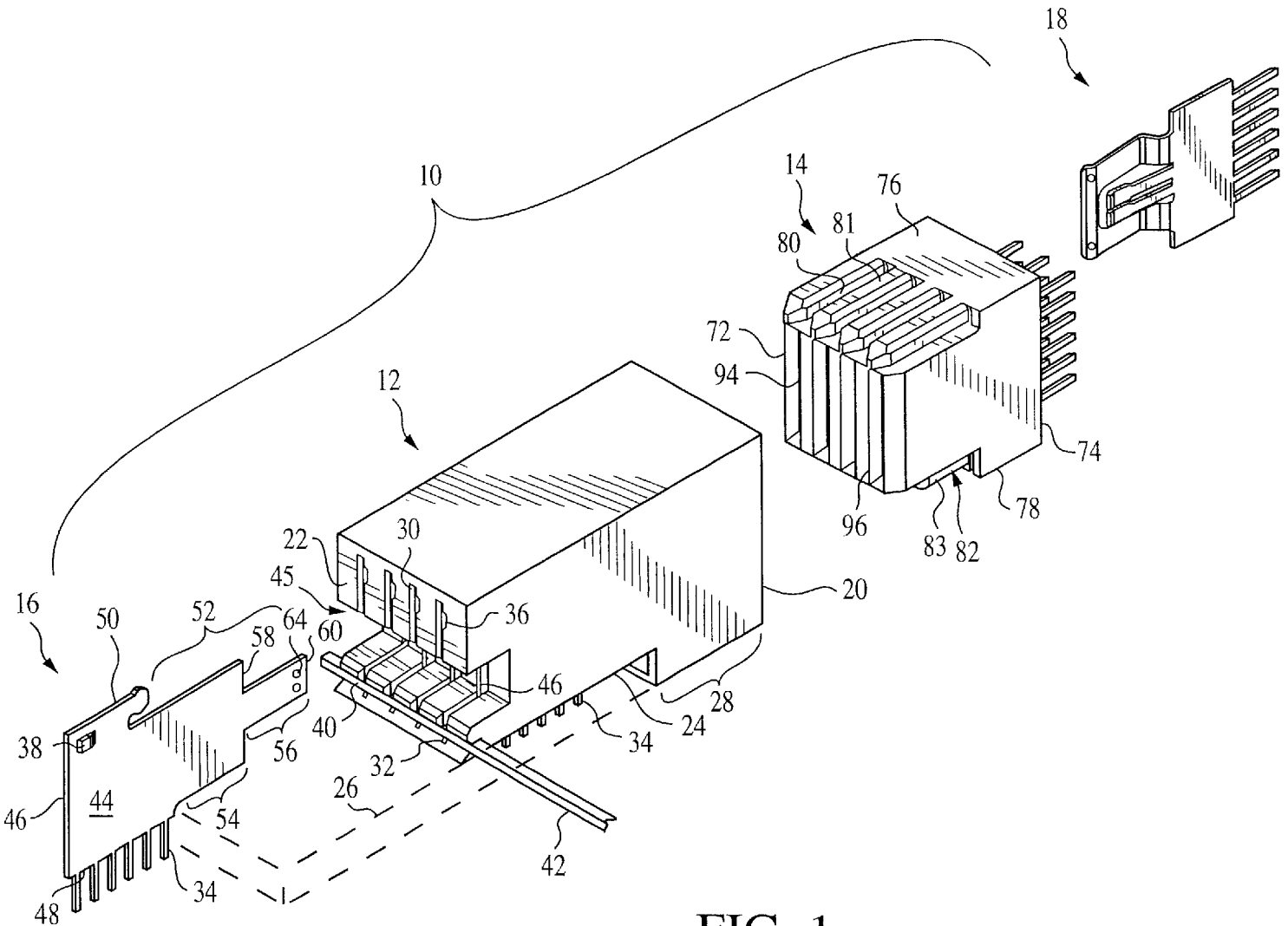
FIG. 1 illustrates an exploded isometric view of a connector assembly oriented in a first direction and formed in accordance with at least one embodiment of the present invention.
Figure 2:
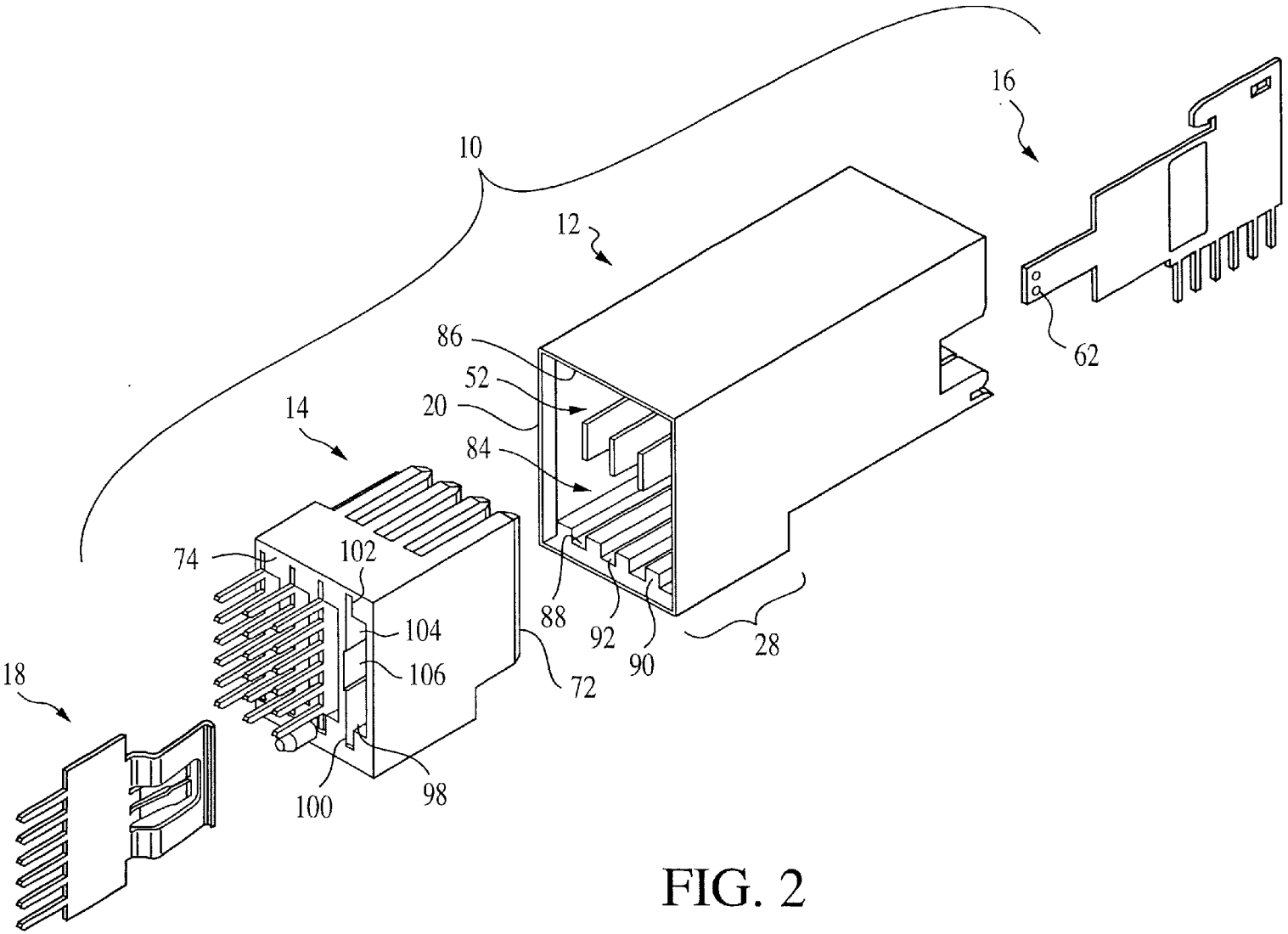
FIG. 2 illustrates an exploded isometric view of a connector assembly oriented in a direction opposite the direction of FIG. 1, and formed in accordance with an embodiment of the present invention.

FIG. 1 and 2 illustrate an electrical connector assembly 10 from opposite ends formed in accordance with an embodiment of the present invention. The electrical connector assembly 10 includes an insulated blade contact housing 12 and an insulated receptacle contact housing 14 adapted to mate with one another to form a separable interface therebetween. The blade contact housing 12 frictionally retains a plurality of blade contacts 16, while the receptacle contact housing 14 frictionally retains a plurality of receptacle contacts 18.

During a mating operation, the blade contact housing 12 and receptacle contact housing 14 are joined by moving from an initial mated position to a final mated position. While in the initial mated position, a dedicated arcing zone of the blade and receptacle contacts 16 and 18 are the only portion of the contacts that engage one another to direct arcing to the designated zone, such as for the discharge of static electricity therebetween or hot-plugging. As the blade and receptacle contact housings 12 and 14 are further moved to final mated positions, the arcing zones may disengage, while primary interface regions of the blade and receptacle contacts 16 and 18 come into contact, and slidably engage one another in a pressure fit to support the flow of high current at high voltage therebetween, when used as power contacts, and to support the passage of data signals with a low SNR, when used as data signal contacts.

As shown in FIG. 1, the blade contact housing 12 includes front and rear faces 20 and 22, respectively. The blade contact housing 12 may be constructed as a right angle interface with a bottom face 24 adapted to be securely mounted to a structure such as a circuit board 26 designated in dashed lines. By way of example, the circuit board 26 may constitute a mother or daughter board, or any other card or component such as used in telecommunications applications, server applications, internet applications, computers and the like. The blade contact housing 12 includes a blade shroud 28 formed at one end. The bottom of the blade shroud 28 extends down over the edge of the circuit board 26. As better shown in FIG. 2, the shroud 28 houses knife portions 52 of the blade contacts 16 once frictionally secured within the receptacle contact housing 14 to engage the blade contacts 16.

The rear face 22 of the blade contact housing 12 includes a plurality of slots 30 formed therein and adapted to receive the blade contacts 16. Bottom edges 32 of the slots 30 include openings therethrough to permit the pins 34 on the blade contact 16 to project downward below the bottom edge 24. The pins 34 are securely mounted to through holes, vias, traces and the like on the circuit board 26. The slots 30 include notched channels 36 provided on at least one side of the slots 30 to receive anti-rotation bosses 38 provided on at least one side of the blade contacts 16.

The rear face 22 also includes a notch 40 extending transversely across the rear face 22 and located proximate the bottom face 24. The notch 40 is adapted to receive a stiffener bar 42 that joins multiple blade contact housings 12 prior to attachment to the circuit board 26. Joining multiple contact housings 12 may be desirable to present a package of connector assemblies, including both ground and signal connectors as a single assembly to customers. In addition, a larger U-shaped cut-out 45 is provided transversely across in the rear face 22. The cut-out 45 is notched deep enough such that, when the blade contacts 16 are fully inserted, the rear edges 46 are exposed in order that they may be utilized for assembly.

Figure 3:
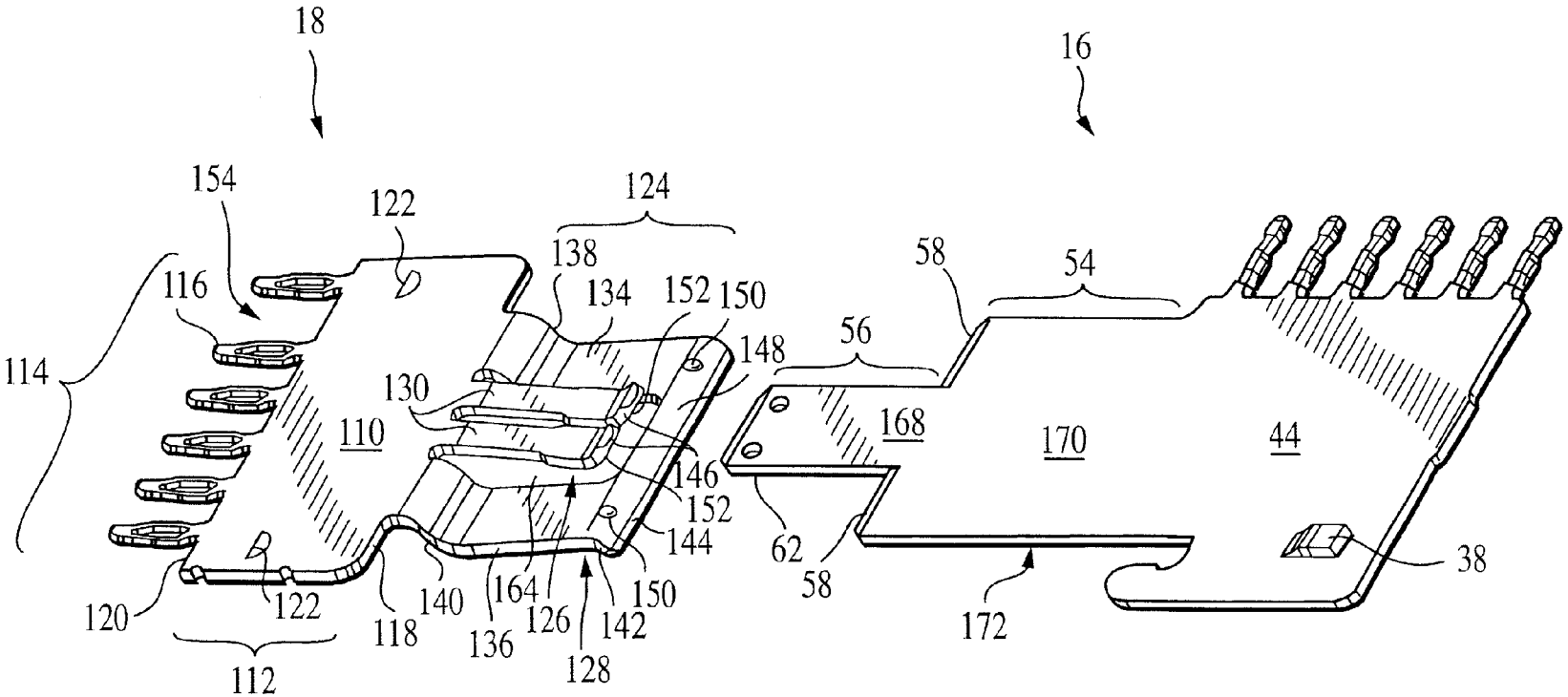
FIG. 3 illustrates a receptacle and blade connector pair formed in accordance with an embodiment of the present invention.

With reference to FIGS. 1–3, the blade contact 16 may be formed as a single integral piece or from an assembly of parts. The blade contact 16 includes a main body 44 having a rear edge 46, a bottom edge 48, a top edge 50 and leading knife section 52 extending forward of the body 44. Pins 34 are formed with or secured to the bottom edge 48 and extend downward aligned in the plane containing the blade contact 16. The pins 34 may constitute compliant pins. Optionally, the pins 34 may be pins having a flared width in the direction of the thickness of (or perpendicular to the plane of) the blade contact 16, or shaped as eye-of-needle type pin. By providing a flared width, the pins 34 maintain a more secure friction fit within holes or vias in the circuit board 26. Optionally, the pins 34 may have compliant tails or tails that are soldered to the joining piece. In the embodiment of FIG. 1, the blade contact 16 is formed as a right angle contact, whereby the pins 34 are arranged at a right angle to the lead knife section 52. However, the blade contact 16 may be formed in other configurations and need not be a right angle contact.

The leading knife section 52 includes a primary mating region or section 54 and an arc/lead arm 56 extending beyond the primary mating section 54. The primary mating section 54 includes a mating edge 58, while the arc/lead arm 56 includes a lead edge 60. The length of the knife section 52 and arc/lead arm 56 may vary to control the sequence in which contacts 56 are mated to control an order in which voltages are applied. The lead arm 56 includes arc zones 62 (FIG. 2) defined thereon and provided on at least one side thereof. The arc zones 62 may be formed in several manners, such as dimples, convex projections, or embossments stamped in the blade contact 16. Optionally, the arc zones 62 may be formed from plating, plates, coating and the like that are particularly resistive to the current and voltage spikes experienced during arcing and hot-plugging. In the embodiment if FIGS. 1 and 2, the arc zones 62 represent dimples or embossments projecting toward the side of the blade contact 16 illustrated in FIG. 2. The side of the blade contact 16 illustrated in FIG. 1 shows the reverse side of the dimples as divots 64.

The blade contact housing 12 and receptacle contact housing 14 separately may be formed as individual integral pieces, such as through injection molding and the like.

The receptacle contact housing 14 includes a front face 72, a rear face 74, a top side 76 and a bottom side 78. The top and bottom sides 76 and 78 are formed with top and bottom channels 80 and 82, respectively, which extend from the front face 72 rearward to form ribs 81 and 83 therebetween. The top and bottom channels 80 and 82 cooperate with similar features inside of the blade shroud 28 to ensure proper orientation and alignment between the blade and receptacle contact housings 12 and 14 during the mating operation.

More specifically, as illustrated in FIG. 2, the blade shroud 28 defines a cavity 84 into which extend the leading knife sections 52 of the blade contacts 16. Interior top and bottom surfaces 86 and 88 of the blade shroud 28 include a plurality of ribs 90 having channels 92 therebetween extending from the front face 20 backward into the cavity 84. The ribs 90 and channels 92 cooperate with the bottom channels 82 and ribs 83 and top channels 80 and ribs 81 on the receptacle contact housing 14 to ensure proper orientation and alignment therebetween when mated. While not illustrated, the top surface 86 includes ribs and channels similar to ribs 90 and channels 92. Optionally, leading ends of the top and bottom channels 80 and 82 may be beveled to facilitate engagement with the ribs 90.

Returning to FIG. 1, the receptacle contact housing 14 includes a plurality of slots 94 cut therethrough oriented vertically, aligned parallel to one another and extending between the front and rear faces 72 and 74. Lead openings 96 of the slots 94 are beveled to facilitate acceptance of corresponding leading knife sections 52 of each blade contact 16.

With reference to FIG. 2, the rear face 74 of the receptacle contact housing 14 includes the rear openings 98 of the slots 94 which extend entirely through the receptacle contact housings 14. The rear openings 98 are configured with thin bottom and top channels 100 and 102 and a wider midsection 104. A central bevel 106 is cut along one side of each slot 98. The bottom and top channels 100 and 102, midsection 104 and bevel 106 cooperate to accept the various features of the receptacle contacts 18.

Turning to FIG. 3, exemplary blade and receptacle contacts 16 and 18 are illustrated. The receptacle contact 18 may be stamped from a single piece of material or molded or the like. The receptacle contact 18 includes a generally rectangular main body 110 having a length 112 and a width 114 determined based upon the power and/or signal performance requirements. As higher power demands are placed on the receptacle contact 18, the width 114 may be varied. For instance, to afford high current carrying capacity, it may be desirable to provide a width 114 that is as large as permitted by the overall envelope of the receptacle contact housing 14 to provide the maximum area for current flow. By increasing the width 114, additional pins 116 may be added further adding to the current flow capacity.

The main body 110 includes a leading edge 118 and a rear edge 120. The pins 116 are formed on and extend rearward from the rear edge 120. Optionally, the pins 116 may be compliant pins or compliant tails may be action pins, such as with a flared width extending in the direction of the thickness of the main body 110 to enhance frictional engagement of the pins 116 with a circuit card or the like (not shown) that is frictionally affixed thereto. Optionally, pins 116 and 34 may be tails that are soldered or press fit into circuit boards. The main body 110 includes retention embossments 122 stamped therein which frictionally engage interior surfaces within the bottom and top channels 100 and 102 to retain the receptacle contacts 18 in the receptacle contact housing 14. The lead edge 118 includes a contact assembly 124 formed thereon.

In the embodiment of FIG. 3, the contact assembly 124 includes a plurality of spring contact arms aligned to define a thin elongated planar gap 126 therebetween that receives the leading knife section 52 of the blade contact 16. A U-shaped contact arm 128 and a pair of cantilevered contact beams 130 are provided as part of the contact assembly 124 and are aligned to define the gap 126 therebetween. The U-shaped contact arm 128 includes a pair of contact springs 134 and 136 each having bent portions 138 and 140, respectively, at the bases thereof. Outer ends of the contact springs 134 and 136 are joined by a strap 142 having a transverse leading edge 144 that is flared outward. The contact springs 134 and 136 are spaced apart to define an opening 164 therebetween that receives the knife section 56 when moved beyond the initial mating position to the final mating position.

The cantilevered contact beams 130 also includes leading edges 146 that are flared outward away from leading edge 144 to guide the blade contact 16 therebetween. A center portion of the strap 142 is configured to operate as an arc zone 148. The arc zone 148 engages the arc zone 62 on the blade contacts 16.

Embossments 150 are also provided on the U-shaped contact arm 128 separate and apart from the arc zone 148. The embossments 150 may be coated with a material to facilitate conduction, such as gold plating and the like. The embossments 150 contact the primary mating section 54 of the leading knife section 52 on the blade contact 16 when the contacts are in a fully mated position. In addition, embossments 152 may be provided on the cantilevered contact beams 130 and arranged to engage the primary mating section 54 (on the side opposite of the embossments 150) when in a final mated position. Embossments 152 may also be plated with a material to facilitate conduction, such as gold and the like. The embossments 150 and 152 afford multiple contact points between the primary mating section 54 and the receptacle contact 18 and thereby facilitate current flow and improve the power carrying capacity of the mated contacts. As the pressure is increased at the primary mating sections 54, the resistance of the interface decreases and enables more current to flow without heating.

Figure 4:
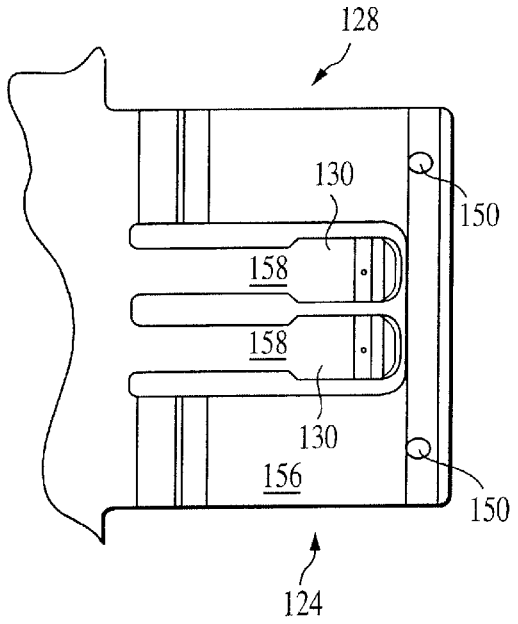
FIG. 4 illustrates a first side view of a portion of a receptacle connector formed in accordance with an embodiment of the present invention.
Figure 5:
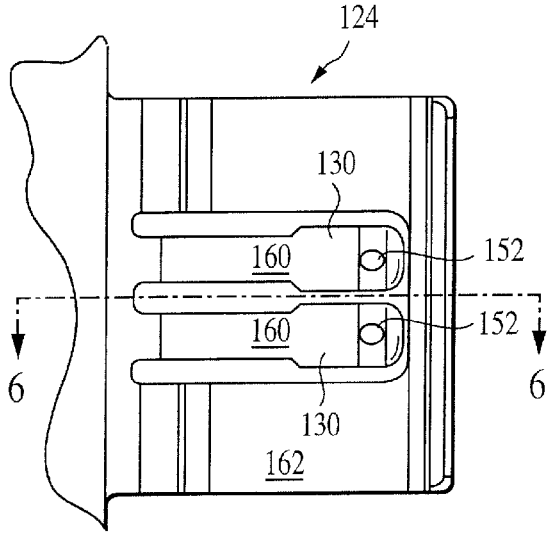
FIG. 5 illustrates a second side view of a portion of a receptacle connector formed in accordance with an embodiment of the present invention.

FIGS. 4 and 5 illustrate opposite sides of the contact assembly 124 to better illustrate the embossments 150 and 152. In FIG. 4, the contact assembly 124 is oriented to show the blade engaging face 156 of the U-shaped contact arm 128 and backsides 158 of the contact beams 130. FIG. 5 illustrates the contact assembly 124 oriented in the reverse direction as compared to the illustration of FIG. 4. In FIG. 5, the contact assembly 124 is oriented to illustrate the blade engaging faces 160 of the contact beams 130 and backsides 162 of the contact arm 128. Embossments 152 are formed on the blade engaging faces 160 of the contact beams 130, while the embossments 150 are located on the blade engaging face 156 of the contact arm 128.

Figure 6:
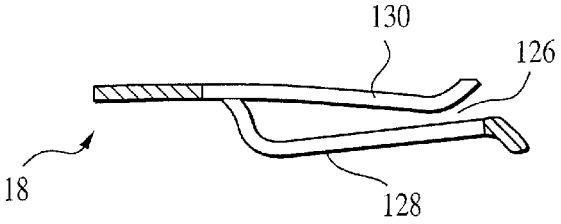
FIG. 6 illustrates a side sectional view of a receptacle connector taken along lines 6—6 in FIG. 4.

FIG. 6 illustrates a side view of a receptacle contact 18 showing the profiles of the contact arm 128 and contact beams 130 with the gap 126 provided therebetween. The illustration of FIG. 6 represents a side sectional view taken along line 6—6 in FIG. 5.

Figure 7:
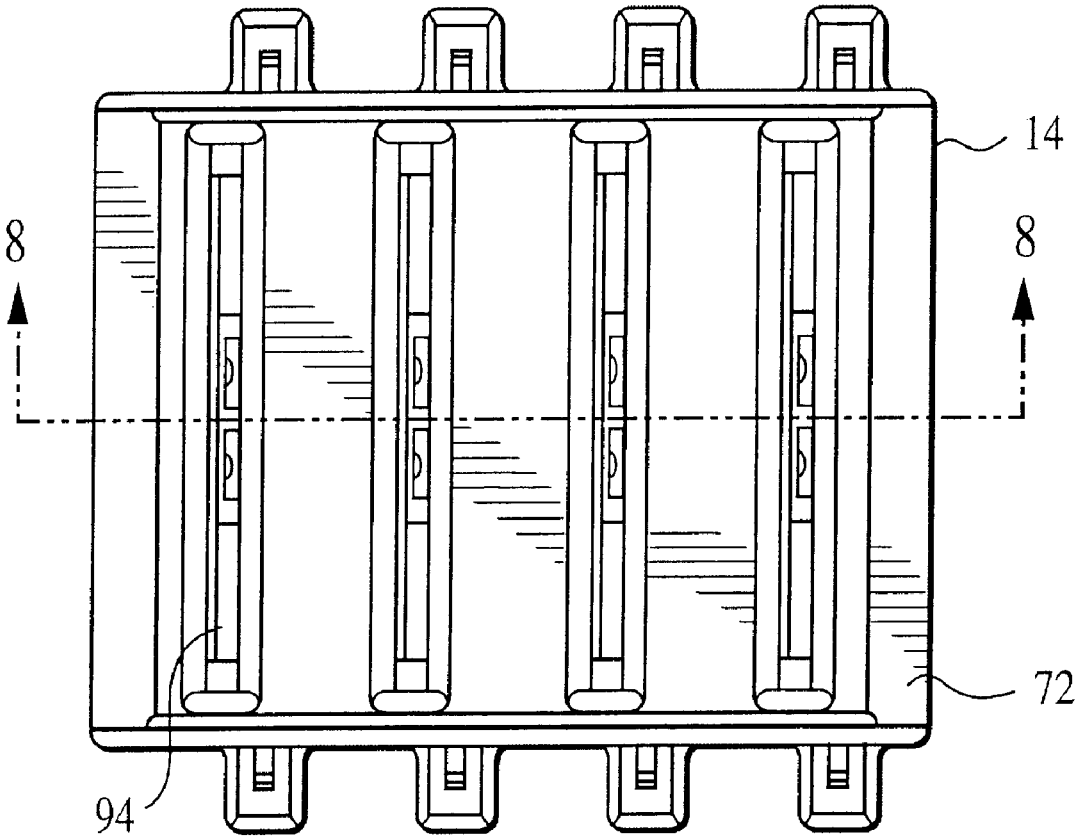
FIG. 7 illustrates a front view of a receptacle connector housing formed in accordance with an embodiment of the present invention.

FIG. 7 illustrates a front view of a receptacle contact housing 14 with receptacle contacts 18 mounted therein. In the example of FIG. 7, the receptacle contact housing 14 is provided with four slots 94 for acceptance receptacle contacts 18, however a different member of slots may be used.

Figure 8:
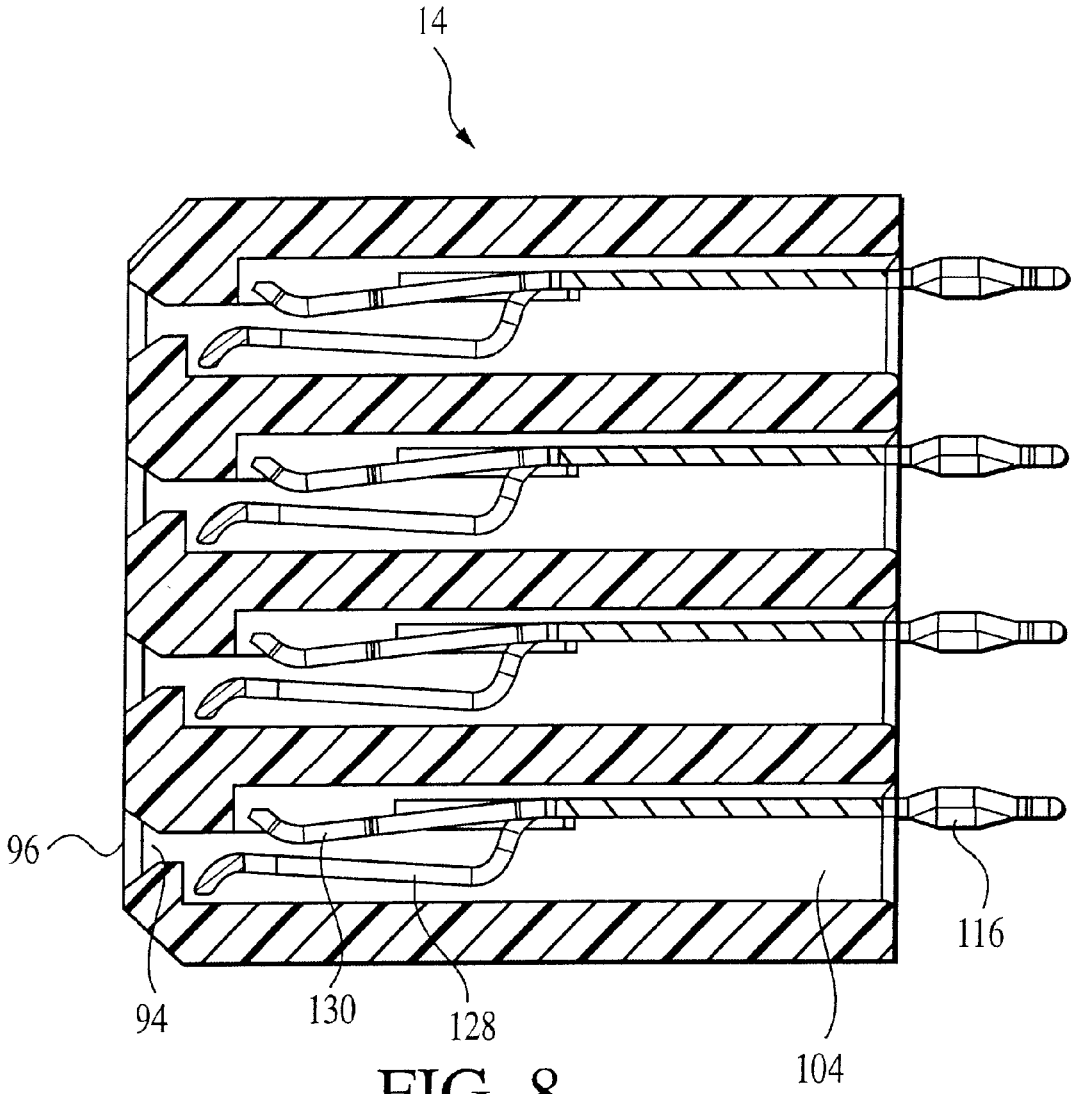
FIG. 8 illustrates a sectional view taken lines 8—8 in FIG. 7 of a receptacle connector housing formed in accordance with an embodiment of the present invention.

FIG. 8 represents a sectional view of the receptacle contact housing 14 of FIG. 7 taken along line 8—8. FIG. 8 illustrates the contour of the slots 94 and lead openings 96 in more detail.

During a mating operation, the blade and receptacle housings 12 and 14 are moved to an initial mated position in which the lead edge 60 of each blade contact 16 is accepted within corresponding slots 94 and engages the arc zone 148 of the contact assembly 124. When the arc zones 62 and 148 engage one another, while at the initial mating position, any static electricity buildup in the circuit board 26 (or in the circuit board mounted to the receptacle contact 14) or hot-plugging power is discharged. The arc zones 62 and 148 arc constructed to exhibit a high tolerance for the electrical characteristics associated with hot-plugging and a static electricity discharge, such as a high current or voltage spikes.

As the blade and receptacle contact housings 12 and 14 are moved from the initial mating position, the lead arm 56 extends into and slides through the opening 164 defined in the center of the U-shaped contact arm 128. As the lead arm 56 moves into the opening 164, the arc zones 62 and 148 disengage. Simultaneously or shortly thereafter, the embossments 152 on the cantilever beams 130 engages an opposite side of the lead arm 56 designated in FIG. 3 as mating zone 168. The embossments 152 slide along the mating zone 168 until the blade and receptacle contacts 16 and 18 are moved to a final mated position.

When in the final mated position, the embossments 152 electrically engage a final mating face 170 on the leading knife section 52 of the blade contact 16. Also, the embossments 150 electrically engage an opposite final mating face 172 on the leading knife section 52 of the blade contacts 16. When in the final mated position, the cantilever beams 130 and contact arms 134 and 136 apply substantially equally and opposite forces upon opposite sides of the blade contact 16. Through application of these equal but opposite forces, the contact assembly 124 maintains a firm electrical interface with the knife section 52 of the blade contact 16.

During a mating operation, blade and receptacle mating zones may only engage one another after the initial mating position and thereafter maintain a primary electrical interface between the blade and receptacle contacts. Blade and receptacle arcing zones may temporarily engage one another when in the initial mating position and thereafter be disengaged as the blade and receptacle contacts are moved from the initial mating position to the final mating position. The blade and receptacle arcing zones and/or mating zones may be formed as raised dimples provided at desired regions of the contacts. For instance dimples intended to supply power are located in power interface regions on the contacts, while dimples intended to serve as static electricity discharge points are located in arcing regions separate and remote from the interface regions. Optionally, the raised bumps intended for arcing may be located in a sacrificial portion of an associated one of the blade and receptacle contacts. Optionally, the strap 142 may be formed as a cross bar separate from or integral with the contact springs 134 and 136.

Figure 9:
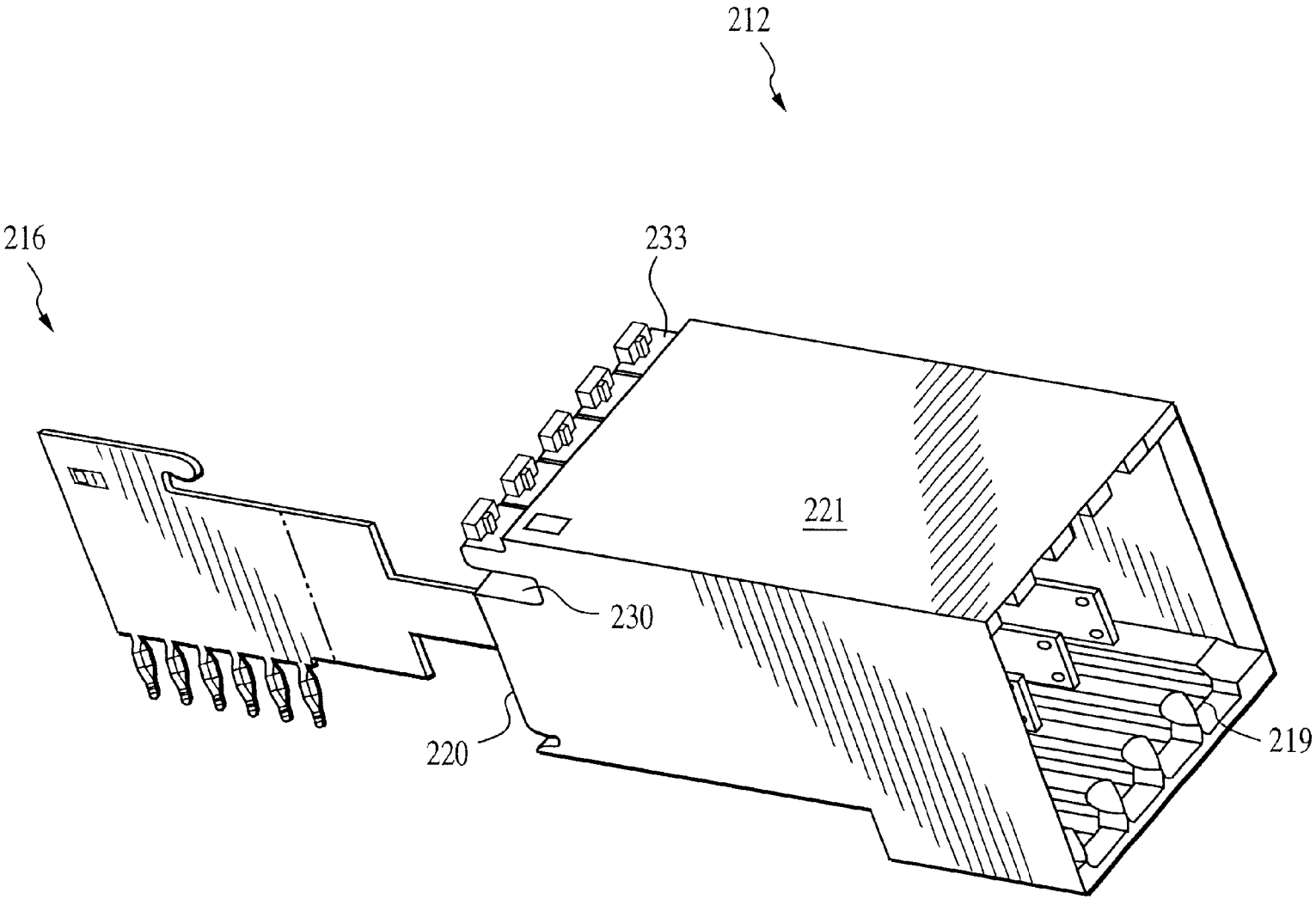
FIG. 9 illustrates a blade contact and blade housing formed in accordance with an alternative embodiment of the present invention.

FIG. 9 illustrates a blade contact 216 and blade contact housing 212 formed in accordance with an alternative embodiment. The blade contact housing 212 includes a slot 230 formed in the rear face 220 proximate the top surface 221. A second notch 233 is provide across the rear end of the top surface 221. Slots 230 and 233 receive retention bars to facilitate the combination of multiple blade contact housings 212 of different shapes and sizes and blade/signal configurations.

Figure 10:
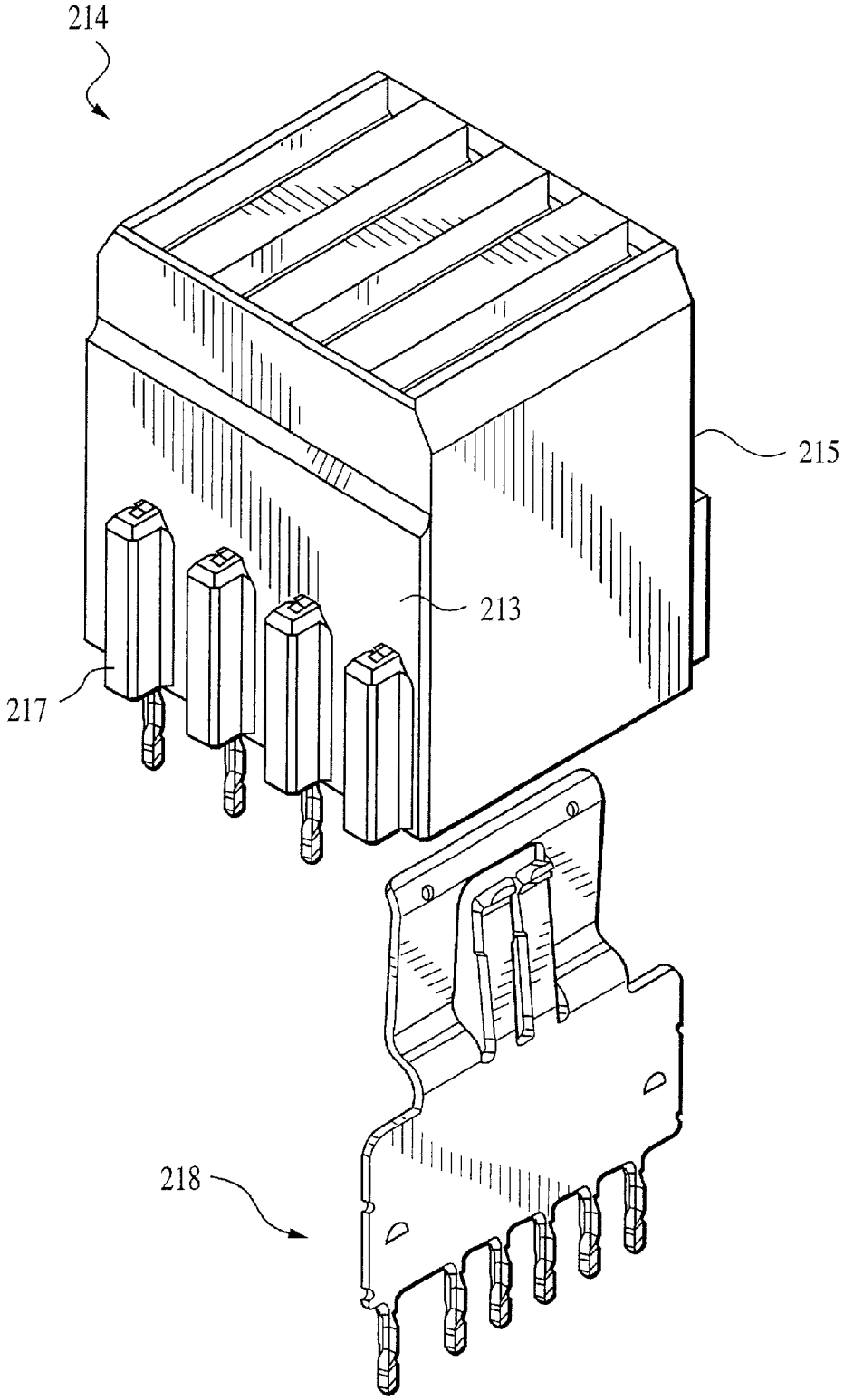
FIG. 10 illustrates a receptacle contact and receptacle housing formed in accordance with an alternative embodiment of the present invention.

FIG. 10 illustrates a receptacle contact housing 214 and receptacle contact 218 formed in accordance with an alternative embodiment. Opposite sides 213 and 215 of the receptacle contact housing 214 are provided with ribs 217 that cooperate with corresponding channels 219 (FIG. 9).

Optionally, the pins 116 may be spaced different distances 154 apart to ensure proper orientation when inserted.

Optionally, the number of contact arms used within the contact assembly 124 may be modified to includes more or fewer cantilever beams 130 on either or both sides. Alternatively, U-shaped contact arms may be afforded on both sides of the blade contact 16, but staggered to ensure that arcing zones engage first on the receptacle and blade contact 16 and 18 before the primary mating interfaces.

Optionally, the arcing zones may be configured in a variety of shapes and structures. For instance, the arcing zones may not include embossments. Alternatively, the arcing zone 148 may include embossments, while the arcing zone 62 may not. Optionally, both arcing zones 62 and 148 may includes embossments. Optionally, the embossments 150 and 152 may be provided in a variety of shapes and sizes. For instance, more than four or fewer than four embossments may be used. Multiple embossments may be used on each contact arm. The shape of the embossment may be varied and the location thereof may be changed. The embossments 150 and 152, optionally, may be constructed separately from the contacts and provided thereon during the manufacturing process, such as through screws, gluing, coating and arc resistant material and the like on the contacts.

While particular elements, embodiments and applications of the present invention have been shown and described, it will be understood, of course, that the invention is not limited thereto since modifications may be made by those skilled in the art, particularly in light of the foregoing teachings. It is therefore contemplated by the appended claims to cover such modifications as incorporate those features which come within the spirit and scope of the invention.

What is claimed is:

1. A pair of mating electrical contacts, comprising:

a blade contact having a support section that is securely mounted in an insulated connector housing and having at least one contact knife projecting from said support section;

a receptacle contact having a base section that is securely mounted in an insulated receptacle housing and having a pair of contact springs projecting from said base section, said pair of contact springs having outer ends joined by a strap, said blade and receptacle contacts being joined in a mating operation as said blade and receptacle contacts move from initial to final mating positions;

blade and receptacle mating zones defined on said blade and receptacle contacts, respectively, that electrically engage one another when in said final mating position to maintain a primary electrical interface between said blade and receptacle contacts, said receptacle mating zones including raised bumps located proximate opposite ends of said strap; and blade and receptacle arcing zones defined on said blade and receptacle contacts, respectively, that electrically engage one another when in said initial mating position to provide a temporary electrical interface for discharge of arcing between said blade and receptacle contacts, said receptacle arcing zone being located in a center portion of said strap, said receptacle arcing zone being separate and distinct from said raised bumps.

2. The pair of mating electrical contacts of claim 1, further comprising:

raised dimples on said blade and receptacle contacts defining at least one signal/power interface region and at least one arcing region located separate and remote from one another, said signal/power interface region maintaining said primary electrical interface and said arcing region providing said temporary electrical interface.

3. The pair of mating electrical contacts of claim 1, further comprising:

multiple raised bumps defining at least one of said blade and receptacle arcing zones, said bumps being located on a sacrificial portion of an associated one of blade and receptacle contacts remote from said primary electrical interface.

4. The pair of mating electrical contacts of claim 1, further comprising:

multiple raised bumps defining at least one of said blade and receptacle mating zones, said bumps being located on a portion of an associated one of blade and receptacle contacts remote from areas that potentially experience arcing during said mating operation.

5. The pair of mating electrical contacts of claim 1, wherein said receptacle contact further comprises:

first and second contact springs projecting forward from said base section; and a cross bar connecting outer ends of said first and second contact springs, said cross bar including said receptacle arcing zones thereon.

6. The pair of mating electrical contacts of claim 1, wherein said receptacle contact further comprises:

first and second contact springs projecting forward from said base section and defining a gap there between to receive said contact knife; at least one of said first and second contact springs including said receptacle mating zone thereon.

7. The pair of mating electrical contacts of claim 1, wherein said receptacle contact further comprises:

a contact spring assembly projecting forward from said base section, said contact spring assembly including a proximal region near said base section constituting said receptacle mating zone and a distal region remote from said base section constituting said receptacle arcing zone, said distal region coming into contact with said blade contact during said mating operation when in said initial mating position, said proximal region coming into contact with said blade contact during said mating operation when in said final mating position.

8. The pair of mating electrical contacts of claim 1, wherein said receptacle contact further comprises:

a U-shaped contact spring with opposed spring legs projecting forward from said base section and an interconnect joining outer ends of said spring legs, said interconnect including arcing zones thereon, said spring legs including mating zones thereon.

9. The pair of mating electrical contacts of claim 1, further comprising:

a plurality of spring action pins mounted to said support section of said blade contact adapted to be mounted fixedly to a circuit board.

10. The pair of mating electrical contacts of claim 1, further comprising:

a plurality of spring action pins mounted to said base section of said receptacle contact adapted to be mounted fixedly to a circuit board.

11. The pair of mating electric contacts of claim 1, wherein said blade and receptacle arcing zones disengage one another when in said final mating position.

12. The pair of mating electrical contacts of claim 1, wherein said blade and receptacle mating zones remain disengaged while said receptacle and blade contacts are in said initial mating position.

13. The pair of mating electrical contacts of claim 1, wherein said blade and receptacle arcing zones defined on said blade and receptacle contacts, respectively, and said blade and receptacle mating zones defined on said blade and receptacle contacts, respectively, are separate and distinct zones on both said blade and receptacle contacts, respectively.

14. The pair of mating electrical contacts of claim 1, wherein said blade mating zone and said blade arcing zone are separate and distinct zones on said blade contact.

15. The pair of mating electrical contacts of claim 1, wherein said receptacle mating zone and said receptacle arcing zone are separate and distinct zones on said receptacle contact.

16. An electrical contact assembly, comprising:

an insulated blade connector housing having a mating cavity in one end thereof;

an insulated receptacle connector housing having a mating section adapted to be inserted into said mating cavity during a mating operation;

a blade contact that is securely mounted in said insulated blade connector housing having at least one contact arm extending into said mating cavity;

a receptacle contact that is securely mounted in said insulated receptacle housing having a pair of contact springs housed within said mating section, said pair of contact springs having outer ends that are joined by a strap;

said blade and receptacle housings being joined in a mating operation in which said blade and receptacle contacts move from initial to final mating positions;

mating interfaces on said blade and receptacle contacts positioned to electrically engage one another when said blade and receptacle housings are moved to said final mating position, said mating interfaces maintaining a primary electrical interface between said blade and receptacle contacts, said mating interfaces on said receptacle contacts including raised mating zones located on opposite ends of said strap; and arcing points on said blade and receptacle contacts and located remote from said mating interfaces, said arcing points temporarily electrical communicate with one another when in said initial mating position to provide a temporary electrical interface affording an arcing point between said blade and receptacle contacts, said arcing point on said receptacle contact including an arcing zone provided in a center portion of said strap separate and distinct from said raised mating zones.

17. The electrical connector assembly of claim 16, further comprising:

raised dimples on said blade and receptacle contacts defining said mating interfaces and said arcing points.

18. The electrical contact assembly of claim 16, further comprising:

multiple raised bumps located on at least one of said blade and receptacle contacts defining mating interfaces on at least one of said blade and receptacle contacts, said bumps being located on a portion of an associated one of said blade and receptacle contacts remote from areas that potentially experience arcing during said mating operation.

19. The electrical connector assembly of claim 16, further comprising:

first and second contact springs housed within said mating section of said receptacle connector housing; and a cross-bar connecting outer ends of said first and second contact springs, said cross bar including said arcing points of said receptacle contact.

20. The electrical connector assembly of claim 16, further comprising:

first and second contact springs projecting forward into said mating section of said receptacle connector housing and defining a gap therebetween to receive said blade contact, at least one of said first and second spring contacts including mating interfaces of said receptacle contacts.

21. The electrical contact assembly of claim 16, further comprising:

a U-shaped contact spring with opposed spring legs projecting into said mating section of said receptacle connector housing and an interconnect joining outer ends of said spring legs, said interconnect including arcing points thereon, said spring legs including mating interfaces thereon.

22. The electrical contact assembly of claim 16, wherein said mating interface on said blade contact is separate and distinct from said arcing point on said blade contact.

23. The electrical contact assembly of claim 16, wherein said mating interface on said blade contact is separate and distinct from said arcing point on said blade contact.

24. The electrical contact assembly of claim 16, wherein said mating interface on said receptacle contact is separate and distinct from said arcing point on said receptacle contact.

* * * * *